US005086917A

United States Patent [19]

Dziersk et al.

[11] Patent Number: 5,086,917

[45] Date of Patent: Feb. 11, 1992

[54] UTILITY CADDY FOR USE WITH OR WITHOUT A BUCKET

[75] Inventors: Mark Dziersk, Simsbury, Conn.; Melissa Rader, Mendon, N.Y.; A. Stanley Tucker, Pleasanthope, Mo.; Walter Wilsford, Shreve, Ohio

[73] Assignee: Mobil Oil Corporation, Fairfax, Va.

[21] Appl. No.: 673,739

[22] Filed: Mar. 22, 1991

[51] Int. Cl.[5] ..... B65D 25/28; B65D 77/00; B65D 1/36

[52] U.S. Cl. ..... 206/216; D3/73; D32/53; 206/510; 206/561; 206/514; 206/203; 220/555; 220/904; 220/500

[58] Field of Search ..... 220/94 A, 904, DIG. 14, 220/555, 500; 206/223, 505, 506, 510, 514, 203, 216; D3/30.1, 73, 74; D32/53; D34/40

[56] References Cited

U.S. PATENT DOCUMENTS

| | | | |
|---|---|---|---|
| D. 230,462 | 2/1974 | Renou | D32/53 |
| D. 236,075 | 7/1975 | Golden et al. . | |
| D. 309,515 | 7/1990 | Robinson | D32/53 X |
| D. 314,279 | 2/1991 | Hotchkiss | D3/30.1 |
| 2,821,327 | 1/1958 | Glazer | 206/203 |
| 2,974,819 | 3/1961 | Melville | 220/555 |
| 3,463,353 | 8/1969 | Peebles | 206/514 |
| 3,600,740 | 8/1971 | Ogler | 15/257 |
| 3,887,103 | 6/1975 | Spooner | 206/203 X |
| 3,907,105 | 9/1975 | Nowak | 206/216 |
| 4,653,713 | 3/1987 | Hamilton . | |

OTHER PUBLICATIONS

Photocopy of 2 Utility Caddies—"Handy Caddy & Convenience Caddy".

*Primary Examiner*—William I. Price
*Attorney, Agent, or Firm*—Alexander J. McKillop; Charles J. Speciale

[57] ABSTRACT

A utility caddy is provided which can be used for transporting cleaning supplies and the like. The caddy includes a pair of triangular compartments separated by a double-walled partition. A handle formed integrally with the partition allows the caddy to be easily carried. The caddy is preferably provided as part of an assembly including a similarly configured bucket. The caddy can be inserted within the bucket so that both items can be stored in a minimal amount of space, or carried together.

19 Claims, 6 Drawing Sheets

UTILITY CADDY FOR USE WITH OR WITHOUT A BUCKET

BACKGROUND OF THE INVENTION

1. Field of the Invention

The field of the invention relates to utility caddies for transporting cleaning supplies and the like.

2. Brief Description of the Related Art

A number of articles have been designed for transporting cleaning supplies, tools, and other objects. Such articles frequently include a handle to facilitate carrying the article and different compartments which may be used for holding selected items. Articles of this general type are disclosed, for example, in U.S. Pat. Nos. 3,600,740, 3,887,103, 3,907,105, 4,653,713 and D314,279.

Utility caddies for transporting cleaning supplies are frequently used in conjunction with a bucket. Despite this fact, there is ordinarily no relationship between the size and shape of the utility caddy with respect to the bucket. The user is accordingly required to carry the bucket and utility caddy separately, even when there is nothing in the bucket.

SUMMARY OF THE INVENTION

It is an object of the invention to provide a utility caddy for facilitating the transport of cleaning supplies and the like.

It is another object of the invention to provide a utility caddy which is space saving, sturdy in construction, and capable of maintaining selected items therein separated from other items.

A still further object of the invention is to provide a bucket/utility caddy assembly including a bucket and a utility caddy which may be carried separately or together.

In accordance with these and other objects of the invention, a utility caddy is provided which includes a receptacle including two pairs of opposing walls having upper edges which define a rim; partition means extending across the receptacle and dividing it into a pair of generally triangular compartments of substantially the same size, each compartment being bounded by an adjoining pair of receptacle walls, the partition, and a bottom wall; and a handle formed integrally with the partition and extending above the rim defined by the upper edges of the receptacle walls. The partition means preferably include a pair of opposing walls which, respectively, bound the respective compartments. Each compartment is accordingly separated by a distance corresponding to the distance between the partition walls.

In accordance with another embodiment of the invention, a bucket/utility caddy assembly is provided which includes a bucket, the bucket including a handle pivotably secured thereto, and a utility caddy. The utility caddy includes a receptacle, partition means dividing the receptacle into first and second compartments, and a handle formed integrally with the partition means. The utility caddy has substantially the same exterior configuration as the bucket, but slightly smaller dimensions such that it can be removably positioned within the bucket. The maximum height of the utility caddy is preferably less than that of the bucket so that it fits entirely within the bucket. Both articles may accordingly be carried using one hand when the caddy is within the bucket.

DETAILED DESCRIPTION OF THE INVENTION

Figure 1:
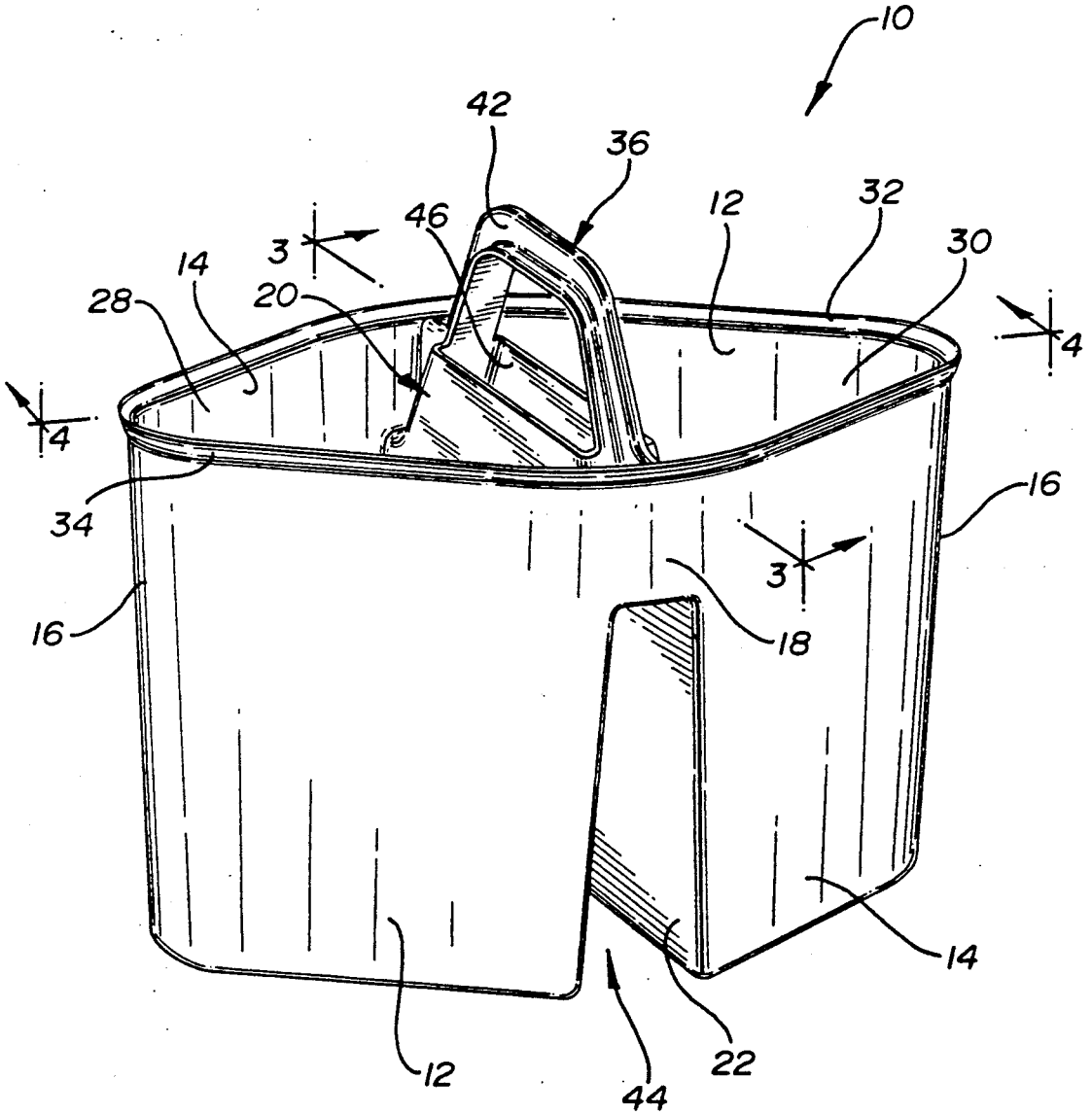
FIG. 1 is a top perspective view of a utility caddy according to the inventor.
Figure 2:
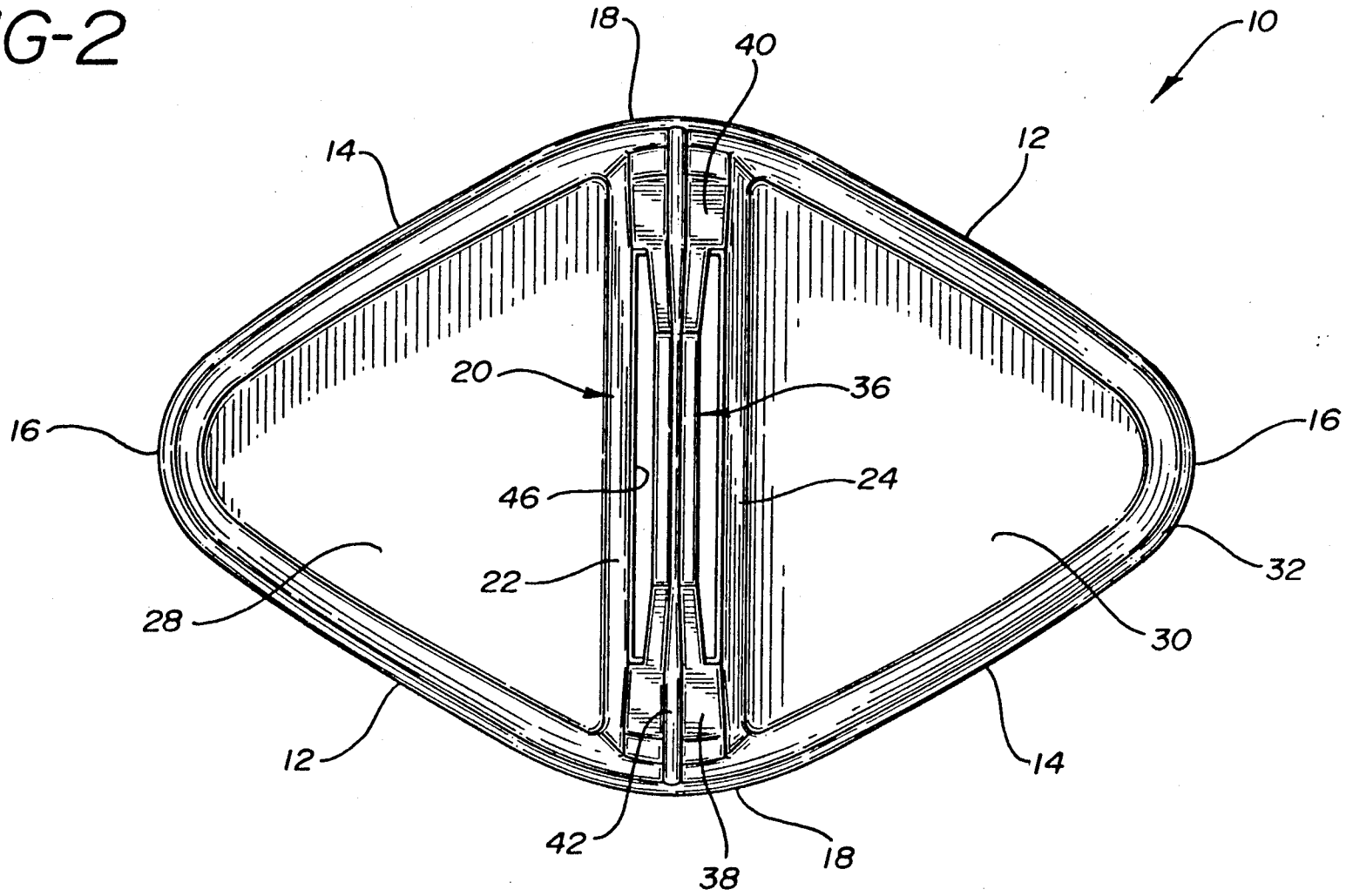
FIG. 2 is a top plan view thereof.
Figure 3:
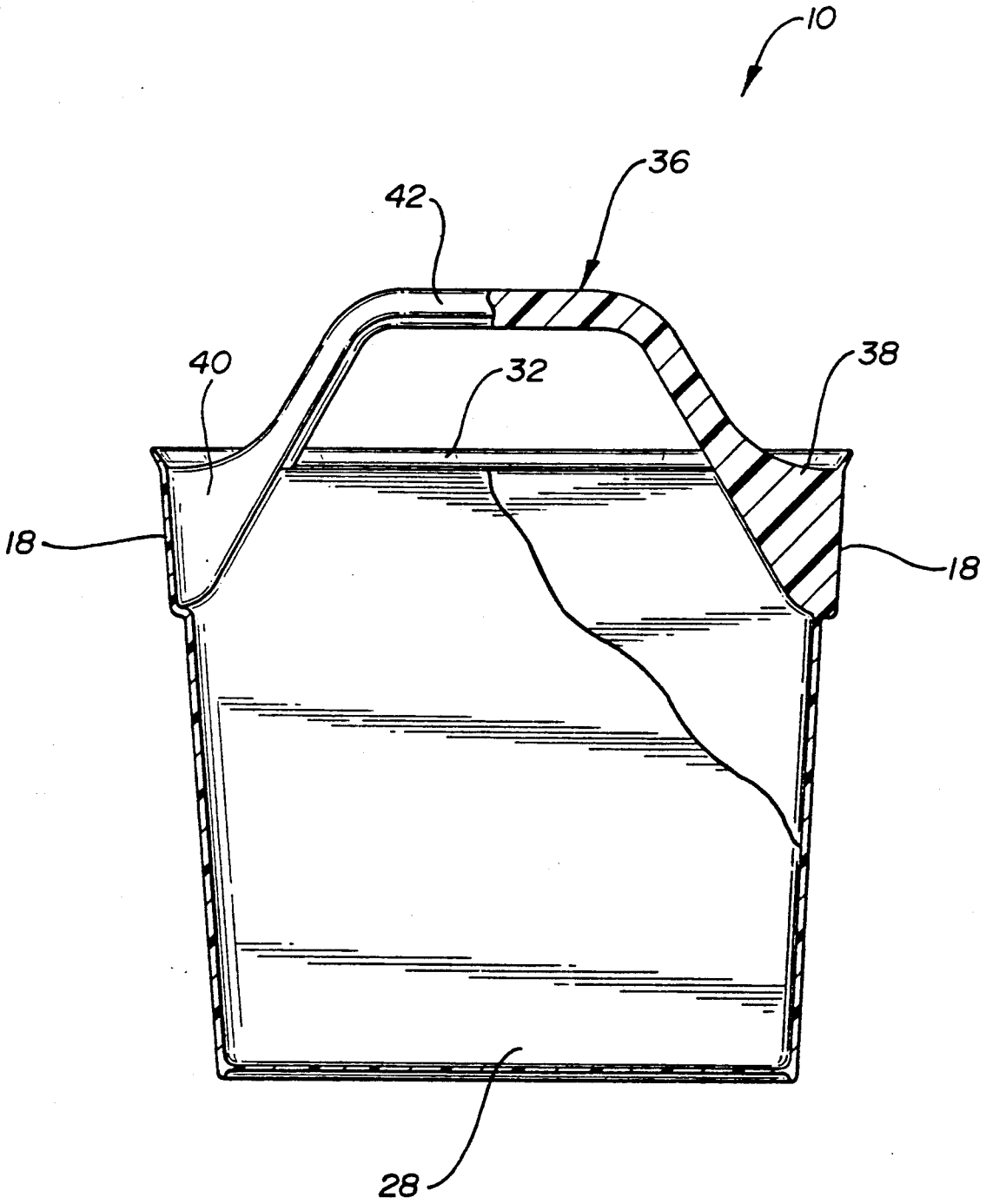
FIG. 3 is partially sectional, side elevation view thereof taken along line 3-3 of FIG. 1.
Figure 4:
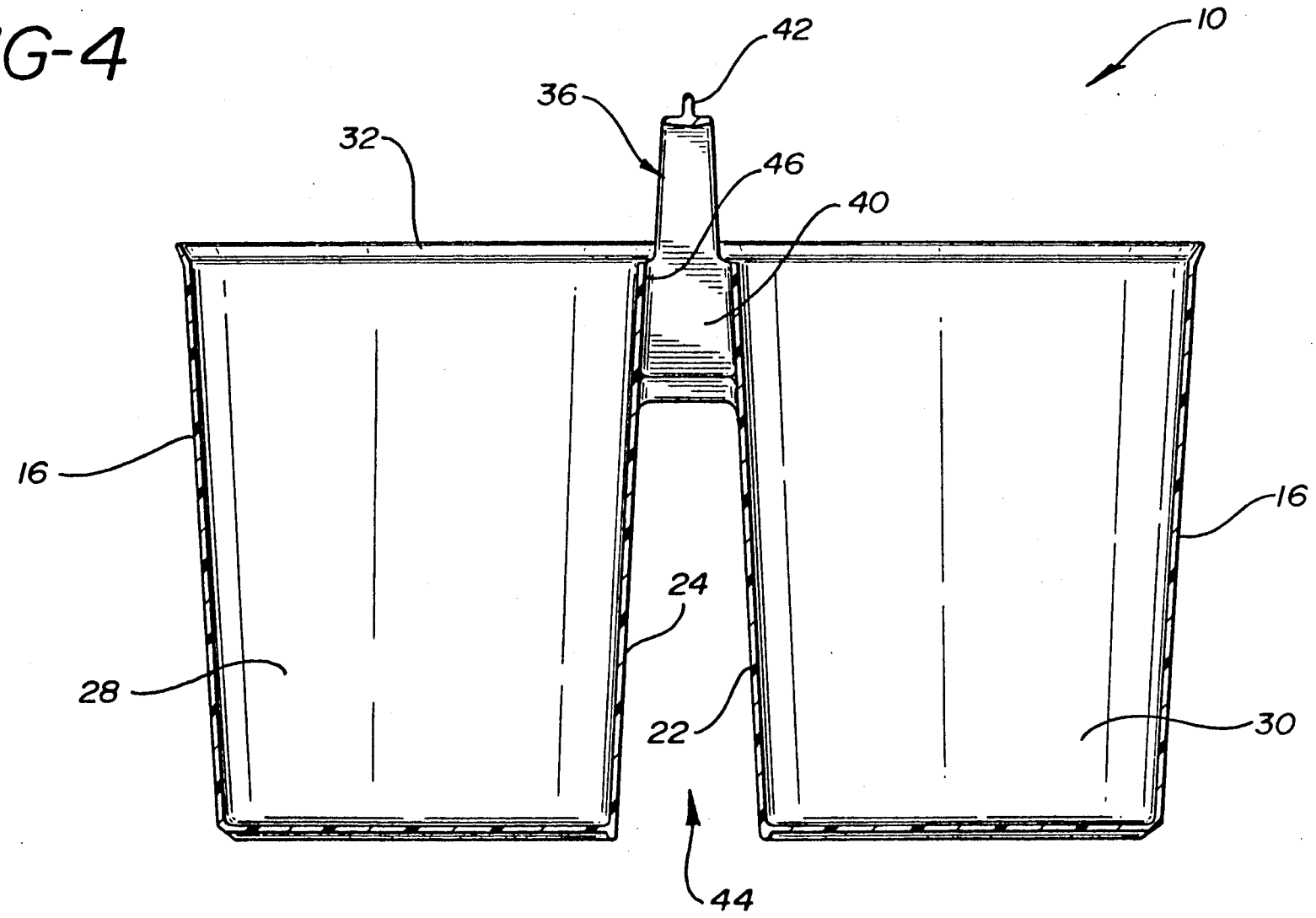
FIG. 4 is a sectional view taken along line 4—4 of FIG. 1.
Figure 5:
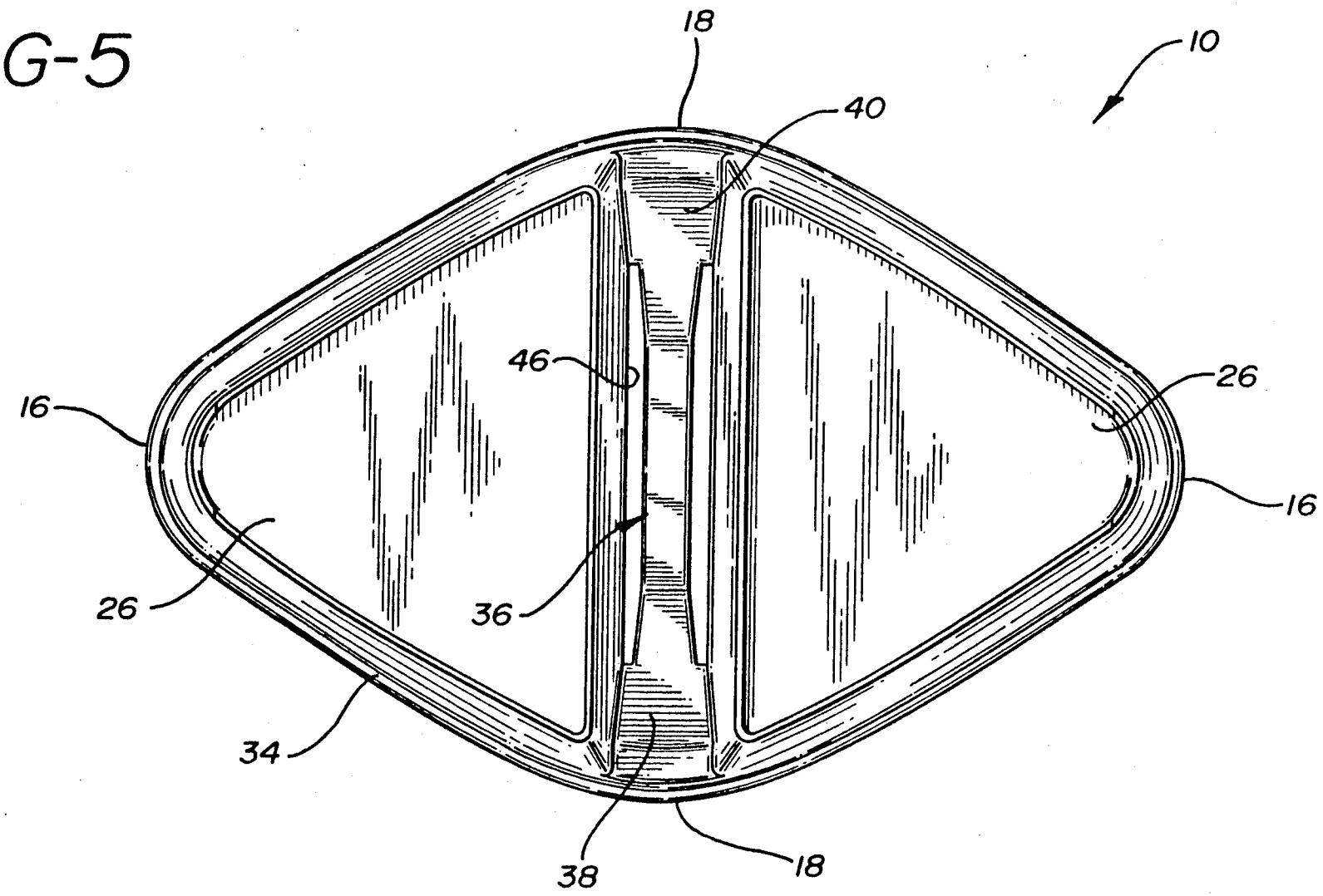
FIG. 5 is a bottom plan view thereof.

Referring to FIGS. 1-5, a utility caddy 10 is provided for carrying cleaning supplies or the like, such as brushes, rags, sponges and soaps or cleansers. The caddy may be integrally molded from a polymeric material such as high density polyethylene. It preferably has a generally diamond-shaped configuration formed by two pairs of opposing sidewalls 12, 14. The walls adjoin at four rounded corners 16, 18, two of which define acute angles and two defining obtuse angles.

A partition 20 extends between the two obtuse angled corners 18 such that the acute angled corners 16 are in opposing relation thereto. The partition 20 includes a pair of opposing walls 22, 24. In addition to adjoining the corners 18, each opposing wall 22, 24 adjoins one of the bottom walls 26 of the utility caddy. The side walls 12, 14, bottom walls 26, and partition walls 22, 24 define a receptacle including first and second generally triangular compartments 28, 30. The top rim 32 defined by the coplanar upper edges of the side walls of the utility caddy is flared outwardly to facilitate the insertion of articles into the respective compartments. A peripheral ridge 34 extends from the bottom surface of each bottom wall 26 except adjacent the acute angled ends thereof. These ends are bevelled so there are no sharp, relatively pointed edges to contact a person carrying the utility caddy.

A handle 36 is formed integrally with the partition. The handle extends above the plane defined by the top rim 32. A pair of webs 38, 40 connect the partition walls 22, 24 to each other. The webs form a continuous wall with the handle and are integral with the respective corners 18 of the utility caddy. A vertically extending continuous ridge 42 extends upwardly from the webs and handle and is joined to the same respective corners 18. The ridge adds strength and rigidity to the caddy without excess weight or material.

The partition walls 22, 24 define a space 44 between the two compartments 28, 30. The space is somewhat wider near the bottom walls 26 than it is near the upper boundary of the space defined by the webs 38, 40 and corners 18. The partition walls 22, 24 define an elongated opening 46 directly beneath the handle which communicates with the space. This construction facilitates nesting and denesting of a stack of such caddies.

The compartments 28, 30 are substantially the same size and are separated by a distance corresponding to the width of the space 44. The handle 36 is positioned directly above the midpoint of the space so that the caddy is balanced when carried by the web.

Figure 6:
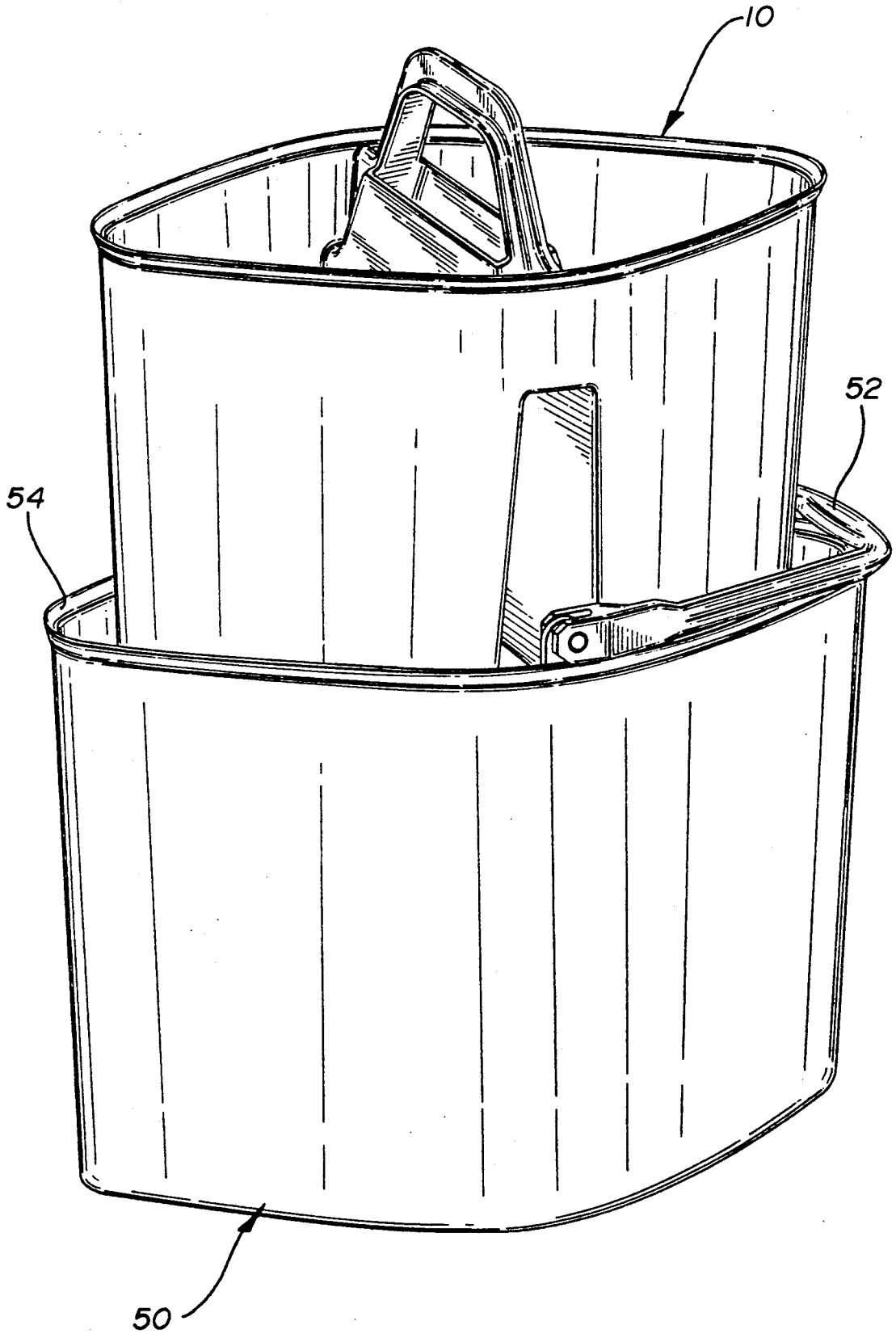
FIG. 6 is a perspective view of the utility caddy partially inserted within a bucket.

The utility caddy 10 may be designed specifically for use in conjunction with a bucket 50 having substantially the same exterior configuration as the utility caddy, but being slightly larger in all appropriate dimensions so that the caddy can be easily inserted therein. Such a bucket is shown in FIG. 6, and includes a handle 52 pivotably secured thereto. This type of bucket is known to the art, and need not be described in detail.

The utility caddy 10 is constructed so that the handle 36 thereof is positioned beneath the rim 54 of the bucket when inserted therein. When seated upon the bottom wall of the bucket, there is sufficient clearance between the rim 32 of the caddy and the bucket walls to allow the caddy to be easily removed. The clearance is small enough that the caddy is substantially maintained in position as the bucket containing the caddy is carried.

In use, the bucket/caddy assembly may be stored as a unit. The caddy may be removed from the bucket and the compartments 28, 30 filled with the appropriate cleaning supplies. The bucket may be filled with water or other cleaning fluid. The bucket and caddy can then be carried separately to the point at which the contents thereof are used. When the task is completed, the bucket is emptied and the caddy, with or without its contents, can be inserted within the bucket. Both articles can then be easily carried back to the storage area.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A utility caddy comprising:

a receptacle including two pairs of opposing walls having upper edges defining a rim;

partition means extending across said receptacle and dividing said receptacle into a pair of generally triangular compartments of substantially the same size, each compartment being bounded by an adjoining pair of said walls, said partition means, an a bottom wall; and a handle formed integrally with said partition means and extending above the rim of said receptacle.

2. A utility caddy as described in claim 1 wherein said partition means include a pair of opposing walls, one of said partition walls bounding one of said compartments, the other of said partition walls bounding the other of said compartments.

3. A utility caddy as described in claim 1 wherein the adjoining pairs of receptacle walls bounding each of the respective compartments define first and second corners having acute angles, said first and second corners being in opposing relation to said partition means.

4. A utility caddy as described in claim 3 wherein said receptacle walls form third and fourth corners having obtuse angles, said partition means adjoining said third and fourth corners.

5. A utility caddy as described in claim 4 wherein said partition means include a pair of opposing walls, one of said partition walls bounding one of said compartments, the other of said partition walls bounding the other of said compartments.

6. A utility caddy as described in claim 5 including first and second webs connecting said partition walls, one of said webs adjoining said third corner, the other of said webs adjoining said fourth corner.

7. A utility caddy as described in claim 6 including a substantially vertical ridge formed integrally with and extending upwardly from said first and second webs and said handle, said ridge having one end adjoining said third corner and an opposite end adjoining said fourth corner.

8. A utility caddy as described in claim 5 including a space defined between said partition walls.

9. A utility caddy as described in claim 8 including a top opening defined by said partition walls, said top opening being positioned beneath said handle and communicating with said space.

10. A bucket/utility caddy assembly comprising:

a bucket, said bucket including a handle pivotably secured thereto; and a utility caddy, said utility caddy including a receptacle, partition means dividing said receptacle into first and second compartments, and a handle formed integrally with said partition means;

said utility caddy having substantially the same exterior configuration as said bucket, but slightly smaller dimensions than said bucket such that said utility caddy can be removably positioned within said bucket.

11. An assembly as described in claim 10 wherein said bucket includes a bottom wall and an upper rim, said utility caddy includes a bottom wall and an upper rim, the handle of said utility caddy extending above the upper rim of said utility caddy, the upper rim of said bucket being positioned above the handle of said utility caddy when the bottom wall of said utility caddy is positioned upon the bottom wall of said bucket.

12. An assembly as described in claim 10 wherein said receptacle includes two pairs of opposing walls having upper edges defining the upper rim thereof, said partition means extending across said receptacle, each of said compartments having a generally triangular configuration of substantially the same size, each compartment being bounded by an adjoining pair of said walls, said partition means, and a bottom wall.

13. An assembly as described in claim 12 wherein the adjoining pairs of receptacle walls bounding each of the respective compartments define first and second corners having acute angles, said first and second corners being in opposing relation to said partition means.

14. An assembly as described in claim 13 wherein said receptacle walls form third and fourth corners having obtuse angles, said partition means adjoining said third and fourth corners.

15. An assembly as described in claim 14 wherein said partition walls include a pair of opposing walls, one of said partition walls bounding one of said compartments, the other of said partition walls bounding the other of said compartments.

16. An assembly as described in claim 15 including first and second webs connecting said partition walls, one of said webs adjoining said third corner, the other of said webs adjoining said fourth corner.

17. An assembly as described in claim 16 including a substantially vertical ridge formed integrally with and extending upwardly from said first and second webs and said handle, said ridge having one end adjoining said third corner and an opposite end adjoining said fourth corner.

18. An assembly as described in claim 15 including a space defined between said partition walls.

19. An assembly as described in claim 18 including a top opening defined by said partition walls, said top opening being positioned beneath said handle and communicating with said space.

* * * * *